US005680016A

United States Patent [19]

Valcke

[11] Patent Number: 5,680,016

[45] Date of Patent: Oct. 21, 1997

[54] TRANSFORMERLESS ELECTRONIC BALLAST FOR GASEOUS DISCHARGE LAMPS

[76] Inventor: Francisco Javier Velasco Valcke, Carrera 4A No. 31-79, Cali, Colombia

[21] Appl. No.: 462,185

[22] Filed: Jun. 5, 1995

Related U.S. Application Data

[63] Continuation-in-part of Ser. No. 295,369, Aug. 24, 1994, abandoned.

[51] Int. Cl.[6] ..... H05B 37/00

[52] U.S. Cl. ..... 315/307; 315/DIG. 5; 315/176; 315/289; 315/205

[58] Field of Search ..... 315/308, 307, 315/209 R, DIG. 5, 205, 176, 103, 105, 106, 107, 289; 363/59, 49

[56] References Cited

U.S. PATENT DOCUMENTS

| | | | |
|---|---|---|---|
| 3,890,539 | 6/1975 | Remery | 315/273 |
| 4,066,930 | 1/1978 | Summa | 315/209 R |
| 4,260,932 | 4/1981 | Johnson | 315/205 |
| 4,289,993 | 9/1981 | Harper et al. | 315/311 |
| 4,327,309 | 4/1982 | Wallot | 315/170 |
| 4,920,302 | 4/1990 | Konopka | 315/307 |
| 4,926,097 | 5/1990 | Taek | 315/307 |
| 5,029,061 | 7/1991 | Shek | 363/21 |
| 5,187,414 | 2/1993 | Fellows et al. | 315/307 |
| 5,262,700 | 11/1993 | Nilssen | 315/223 |
| 5,289,083 | 2/1994 | Quazi | 315/224 |
| 5,365,152 | 11/1994 | Ozawa et al. | 315/291 |
| 5,371,444 | 12/1994 | Griffin | 315/291 |
| 5,410,221 | 4/1995 | Mattas et al. | 315/307 |
| 5,418,435 | 5/1995 | Vamada | 315/308 |

*Primary Examiner*—Robert Pascal
*Assistant Examiner*—Arnold Kinkead
*Attorney, Agent, or Firm*—Vaden, Eickenroht & Thompson, L.L.P.

[57] ABSTRACT

A transformerless ballast for a gaseous discharge lamp is disclosed. The ballast comprises: a rectifier; a filter for the rectifier output; a voltage divider for the filter output; an electronic gate modulating the filter output to power a lamp when the lamp is lit; a controller controlling the electronic gate responsive to variations in lamp impedance and to variations in the voltage divider output; an oscillator generating an output for predetermined period of time until after the lamp is lit; and an amplifier receiving and amplifying the oscillator output for powering the lamp when the lamp is unlit.

20 Claims, 8 Drawing Sheets

TRANSFORMERLESS ELECTRONIC BALLAST FOR GASEOUS DISCHARGE LAMPS

This application is a continuation-in-part of my application Ser. No. 08/295,369 filed Aug. 24, 1994, and now abandoned.

BACKGROUND OF THE INVENTION

1. Field of the Invention

The present invention relates generally to an energizing circuit used for gaseous discharge lamps and, more specifically, to a transformerless ballast circuit for fluorescent lamps.

2. Description of the Prior Art

Ballast circuits in fluorescent lamp systems regulate the electrical current supply to the lamp. Without a ballast, a fluorescent lamp would burn out instantly because there would be no impedance to limit the current; noting in particular that once the lamp is ignited and the gas within is ionized, the impedance across the lamp drops dramatically. Additional ballast circuit functions include providing the proper voltage to start a fluorescent lamp and reducing such voltage to maintain the lamp in a stable and lit condition. Thus, in order to light a fluorescent lamp and maintain the lamp lit, the lamp system must incorporate a ballast circuit that elevates the supply voltage (and sometimes frequency) until it ignites the lamp and then quickly drop the voltage to the lamp.

The vast majority of ballast circuits in this well-known field of art use filaments that release free electrons into the tube (either by thermoionic emission, field emission or a combination of both) and ionize the gas within the lamp. Since these ballasts rely on the use of filaments to ionize the gas within the lamp, such systems limit the lamp's life to the life of its filaments. Thus, after a filament burns out the entire lamp must be discarded. Aside from having to continually replace these lamps, the refuse generated by discarding "burnt-off" lamps presents a serious ecological problem.

These lamps contain heavy metal elements (e.g. mercury) which are extremely dangerous to the environment and very costly to handle during the disposal process. Although it is known in the prior art that a lamp can be lit without a filament (e.g. see Summa, U.S. Pat. No. 4,066,930, column 5), such circuits are extremely expensive. For example, the Summa circuit requires the use of very specialized, and therefore very expensive, transformer components which strictly limit its application to high radio-frequency guns used to test fluorescent lamps at the factory.

In addition, almost all fluorescent lamps currently marketed rely on AC (alternating current) power of various frequencies to both ignite the lamps and maintain the lamps in a lit condition. Since alternating current necessarily cycles the filament, an undesirable fatigue factor is introduced that shortens filament life and overall lamp life. Moreover, in electronic ballasts, the AC power source also induces a 60 Hz "flicker" (or a flicker at whatever frequency the AC supply uses) which, although not noticeable in most domestic environments, may be extremely dangerous in industrial environments where machinery may also be running at 60 Hz or multiples thereof. Moreover, there are also adverse biological effects from a standard lamp's stroboscopic flicker which are discussed in the background of the Invention in Johnson, U.S. Pat. No. 4,260,932.

Known ballasts using DC power can eliminate the stroboscopic effect in applications where it simply cannot be tolerated, such as in high-speed photocopiers. However, maintaining a fluorescent lamp lit with DC current presents other problems. For instance, when a fluorescent lamp is operated at a constant DC current, the lamp goes through a particular process of "mercury migration." This phenomenon results in a non-uniform brightness of the lamp from one of its ends to the other. The mercury migration process has a very gradual effect starting early in the life of the lamp, but it eventually ends in an extremely noticeable difference in light intensity across the lamp. Another problem is an effect known as "anode darkening" that causes lamp's anode to overheat from the constant, excessive electron bombardment. Such overheating damages the phosphors at the lamp's anode end and results in no light being emitted near the anode end after only a few hours of operation on DC current.

It was also found that mercury migration and anode darkening are also dependent on lamp size, current requirements to maintain the lamp lit, and density of ionized gas. Thus, for smaller lamps such as compact fluorescents, or lamps where the mercury gas is denser, such as in T-8 lamps, mercury migration and anode darkening are less of a problem. However, for common T-12 lamps with a 40 Watt rating or above, anode darkening and mercury migration are always a problem.

Mercury migration and anode darkening are typically addressed by including a switching circuit, whereby the switching equalizes wear upon each lamp electrode as each electrode operates as the anode for 50% of the time. The switching process helps prevent phosphor coating migration and the accumulation of a lamp envelope inner surface charge (negative) at the anode end by changing the polarity of the lamp every time it is activated (e.g., every time the photocopier makes one copy) or during very short periods (e.g., every 10–20 seconds). However, these switching circuits also generate other problems such as: the noticeable amount of power consumption, the arcing of the electromechanical relays which are used (thereby causing a malfunction and possible shutdown of the whole system) and the prohibitive cost of the circuits when considered for other applications.

The present invention solves the problem of anode darkening and mercury migration by limiting the amount of the maintenance current to the bare minimum required to maintain the lamp lit. Johnson (U.S. Pat. No. 4,260,932) teaches that the amount of charge accumulation resultant from a unidirectional current is dependent upon the velocity of the electrons and negative ions within the lamp and upon the amount of current flow (density of electrons and negative ions) within the lamp. The velocity of the charged electrons and ions is, in turn, primarily dependent upon the discharge length of the lamp, (this determining the time period during which the negatively charged particles are accelerated), and accelerating voltage (operating voltage) of the lamp. In the case of the present invention, the current used limits the amount of electron and ion bombardment to a minimum, allowing the lamp to recuperate from minor migration during the time it is turned off. However, in conditions where use is continuous or lamp rating is greater than 40 Watts (T-12 lamps), it is desirable to use a switching circuit.

Yet another shortcoming of current ballasts is the use of inductive elements that promote inefficiencies in the system and prevent further miniaturization of the circuit into a chip. The use of coils and transformers, typically employed to step up the ignition voltage, introduces unwanted losses stemming from internal resistances, hysteresis, and Foucault current. Furthermore, these inductive elements also create unwanted electric noise and troublesome interference with radio signals and computer networks. Harmonic distortion and emanation of electromagnetic signals are also common complaints among the more recent "electronic" ballasts.

Practically all currently available ballasts use a transformer of some sort to perform the ballasting function. The older ballasts, termed "electromagnetic", used a simple circuit design wherein a transformer was the essence of the ballast. More recently, higher frequencies are being used (>25 kHz) in order to reduce the size of the transformer, ease ignition of the lamp by using less voltage, and basically eliminate any visible stroboscopic effects. Additionally, various parameters of the ballast have been optimized using electronic circuitry, to which end these newer ballasts are called "electronic" (e.g., making available a dimmer capability), but in the end a transformer is always used to ballast. The presence of this transformer naturally creates a loss since the manner in which the extra energy in the ballasting process is absorbed and converted into heat, not to mention losses due to Foucault currents etc.

The present invention does not use any inductive elements in the ballast circuit. This allows the ballast circuit to be manufactured in integrated circuit form, thereby reducing its size and weight to a point where one could incorporate the circuit into the lamps themselves. This would eliminate the use of specialized production assemblies for fluorescent lamps and create unlimited installation alternatives as well. Additionally, by not using any inductive elements, the losses and other disadvantages attributed to the use of coils in current ballasts are completely eliminated.

It is therefor an object of this invention to provide a transformerless ballast for gaseous discharge lamps.

It is a further object of this invention to provide a ballast for gaseous discharge lamps without either inductors or lamp filaments.

It is a still further object to provide a ballast responsive to fluctuations in supply voltage.

It is a still further object of the invention to provide a ballast powers the lamp responsive to lamp impedance.

It is therefore a general object of the present invention to economically ignite fluorescent lamps without the need for any ionizing filaments, thereby virtually eliminating the need for replacement lamps.

In addition, it is an object of the present invention to economically maintain a gaseous discharge lamp lit using DC current, thereby eliminating and stroboscopic AC effect and minimizing the lamp's energy consumption.

Another object of the present invention is to provide for the solid state integration of the complete ballast circuit and eliminate the use of any inductive elements.

Moreover, an additional object of the present invention is to provide an economical ballast using DC current without the need for expensive switching circuitry.

A related object of the present invention is to provide an improved integrated circuit ballast having such size and weight characteristics that it could be incorporated into the fluorescent lamp itself.

Further objects and advantages of the invention will become apparent to those of ordinary skill in the art upon review of the following detailed description, accompanying drawing, and appended claims.

SUMMARY OF THE INVENTION

The invention is a transformerless ballast for a gaseous discharge lamp comprising: a rectifier; a filter for the rectifier output; a voltage divider for the filter output; means for gating the filter output, the gating means output powering a lamp when the lamp is lit; means for controlling the gating means responsive to variations in lamp impedance and to variations in the voltage divider output; an oscillator generating an output for predetermined period of time until after the lamp is lit; and an amplifier receiving and amplifying the oscillator output for powering the lamp when the lamp is unlit.

Notice must be taken that the drawings are not necessarily to scale and that the embodiments are sometimes illustrated by phantom lines and diagrammatic representations. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PREFERRED EMBODIMENT

Figure 1:
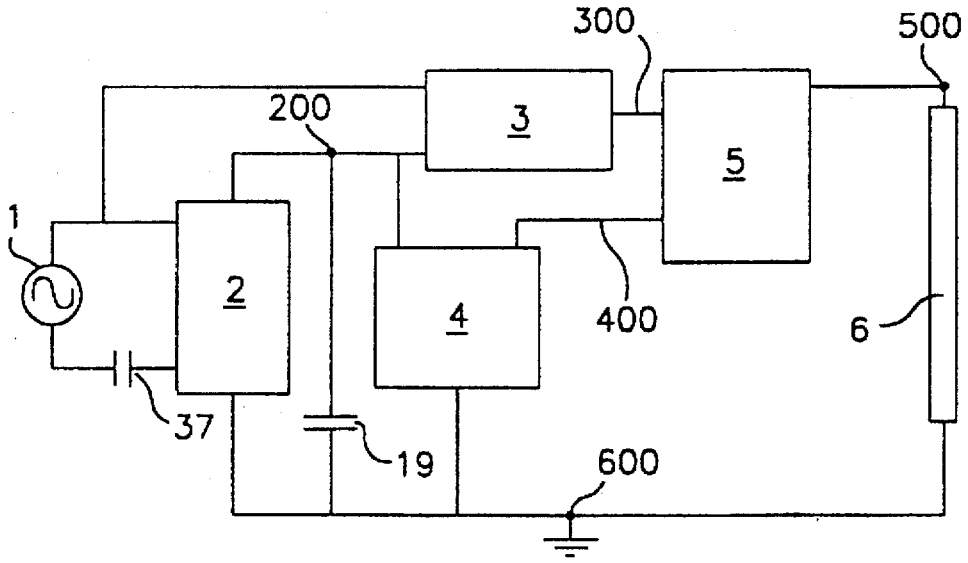
FIG. 1 is a block circuit diagram showing the interconnection between the major components of the present invention.

Turning first to FIG. 1, there is shown the electrical connections between the major block-diagram components which constitute the entire invention. As indicated, the network AC source 1 has power leads to both the rectifier/voltage-doubler 2 and the multiplier circuit 3. The multiplier circuit 3 serves as a voltage multiplier during the ignition stage of the lamp 6. In accordance with the present invention, the ignition of the lamp 6 uses the principle of photoemission, rather than thermoionic or field emission. In doing so, no filament is required for the lamp 6 to be ignited. By obviating the need for a filament altogether, the life of the lamp 6 may be extended immeasurably. Lamp life now only depends on whether or not the gas within the lamp 6 leaks, which in many cases today can be more than 15 years.

The output from the rectifier/voltage-doubler 2 leads both into the multiplier circuit 3 and the low power oscillator 4. In turn, the outputs from the multiplier circuit 3 and low power oscillator 4 lead into the amplifier 5, which feeds the lamp 6. With regard to the normal operation of a fluorescent lamp, the invention basically functions in two stages. First, it permits the gaseous discharge lamp to be ignited using a high frequency/high voltage signal. Second, once the lamp is lit, a switch to DC current occurs, which maintains the lamp in a stable, lit condition.

Figure 2:
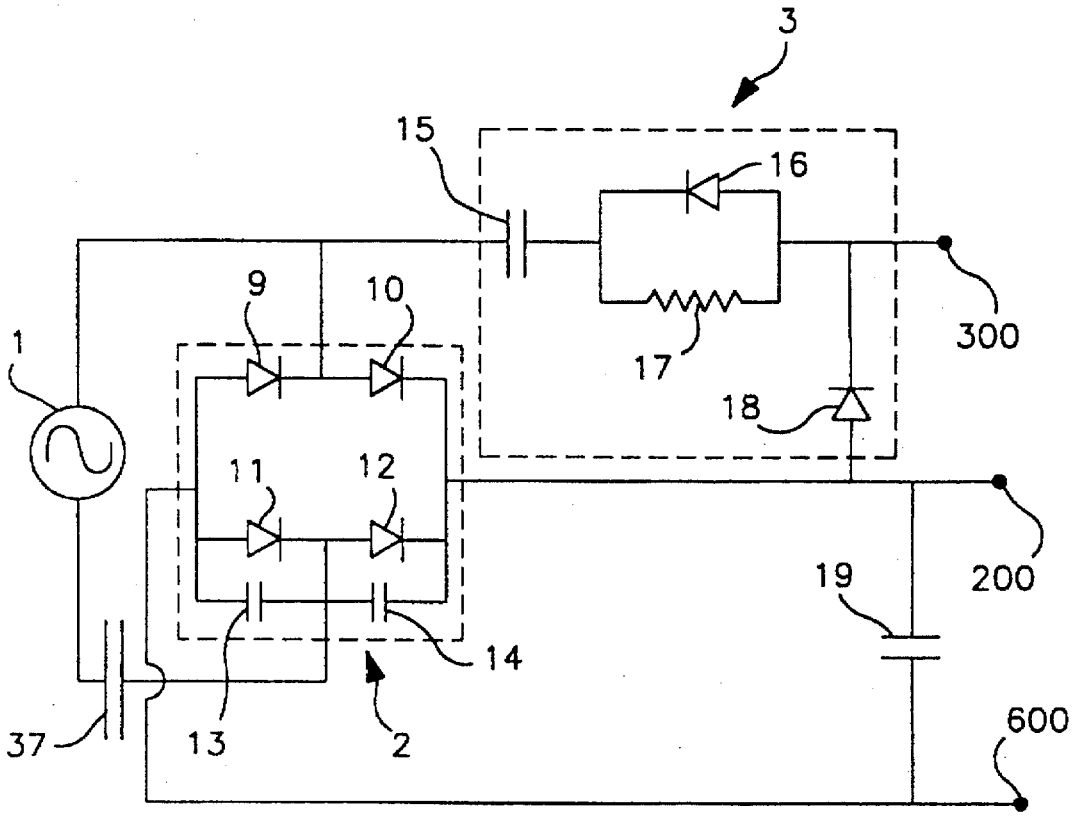
FIG. 2 is an electrical schematic view of block 2 (the rectifier/voltage-doubler) and block 3 (the multiplying circuit) from FIG. 1.

Referring now to FIG. 2., the electrical detail of both the rectifier/voltage-doubler 2 and the voltage multiplier circuit 3 is indicated. The rectifier/voltage-doubler 2 is a full-wave bridge rectifier made up of diodes 9, 10, 11 and 12, and capacitors 13 and 14. When network AC source 1 energizes the entire circuit with voltage $E_{in}$, the rectifier/voltage-doubler 2 outputs at node 200 a DC current having voltage $2\sqrt{2}\,E_{in}$ with a 60 Hz ridge caused by the network AC source 1. Capacitor 19 serves to filter out these 60 Hz ridges in the rectified power signal coming from the rectifier/voltage-doubler 2 before such signal enters the low power oscillator 4.

The output from the rectifier/voltage-doubler 2 connects at node 200 to voltage multiplier circuit 3. Multiplier circuit 3 elevates the voltage used to ignite the lamp 6 to a level of $3\sqrt{2}\,E_{in}$ at node 300. Multiplier circuit 3 elevates the ignition supply voltage by allowing capacitor 15 to be quickly charged via diodes 18 and 16 during the negative cycle of the network AC source 1. Capacitor 15 is charged up to a level of $3\sqrt{2}\,E_{in}$ since this is the net potential between the negative cycle of the network AC source 1 ($-\sqrt{2}\,E_{in}$) and the value at node 300 ($2\sqrt{2}\,E_{in}$). When the zero-point in the cycle comes through, the capacitor 15 discharges the stored $3\sqrt{2}\,E_{in}$ through resistor 17 which, given the minimal current during the ignition stage, presents a negligible drop in potential across itself thereby effectively presenting $3\sqrt{2}\,E_{in}$ at node 300.

Figure 3:
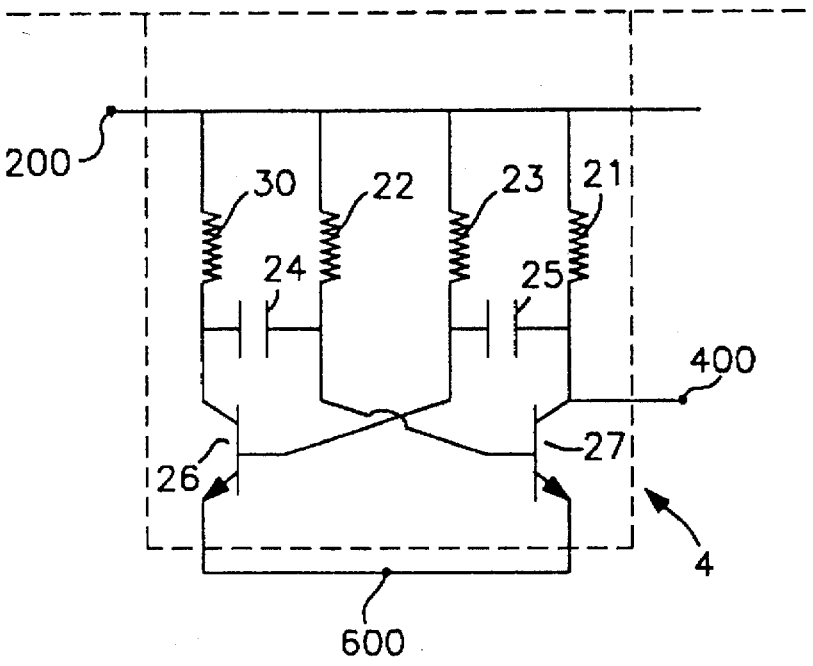
FIG. 3 is an electrical schematic view of block 4 (the low power oscillator) from FIG. 1.

FIG. 3 presents the circuitry and electrical components of the low power oscillator 4, including transistors 26 and 27, capacitors 24 and 25, and resistors 20, 21, 22, and 23. Low power oscillator 4 is a square wave oscillator which receives the filtered DC signal at node 200 ($2\sqrt{2}\,E_{in}$) and outputs a $2\sqrt{2}\,E_{in}$ high frequency signal of 25 kHz at node 400.

Figure 4:
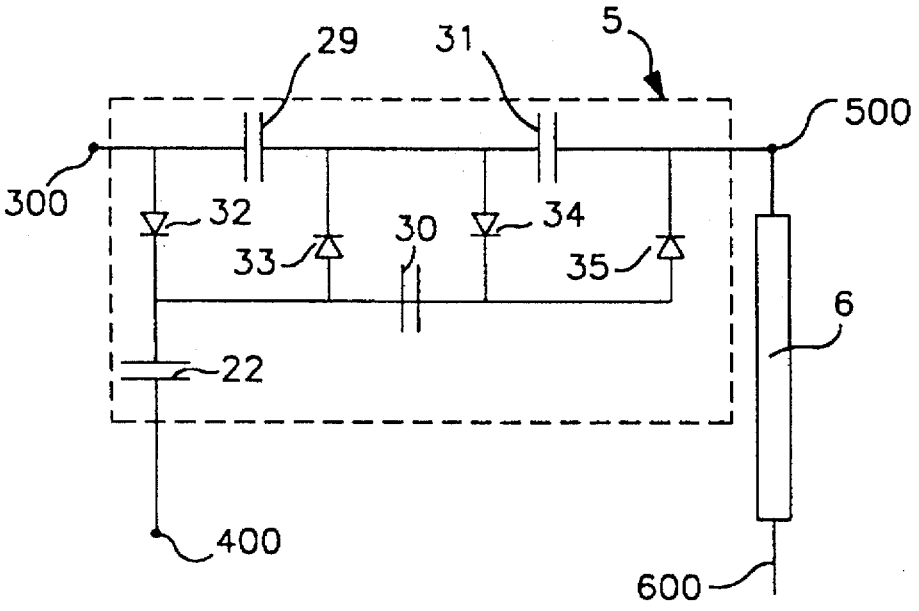
FIG. 4 is an electrical schematic view of block 5 (the amplifier) from FIG. 1.

FIG. 4 shows the amplifier 5 which includes capacitors 28, 29, 30 and 31, and diodes 32, 33, 34 and 35. Amplifier 5 receives as its input both the signal at node 300 (the output from multiplier circuit 3) with a voltage of $3\sqrt{2}\,E_{in}$, and the 25 kHz high frequency signal from node 400 (the output from the low power oscillator 4). Amplifier 5 takes the average voltage from these two signals, $2\sqrt{2}\,E_{in}$, and multiplies it by a multiplication factor of G. For the particular amplifier 5 diagrammed in FIG. 4, the value of G is equal to 4, thus producing a signal having a voltage of $8\sqrt{2}\,E_{in}$ (minus losses) and a 25 kHz frequency. This signal is then fed to the lamp 6 at node 500 which ionizes the gas within and ignites the lamp 6. No filament is necessary within the lamp 6 as the ignition depends only on the photoemission of ions, and not on thermoionic or field emission. All that is needed to ignite and maintain the lamp 6 lit is a conductor, preferably at each end of the lamp 6, in intimate contact with the gas within the lamp 6.

Figure 5:
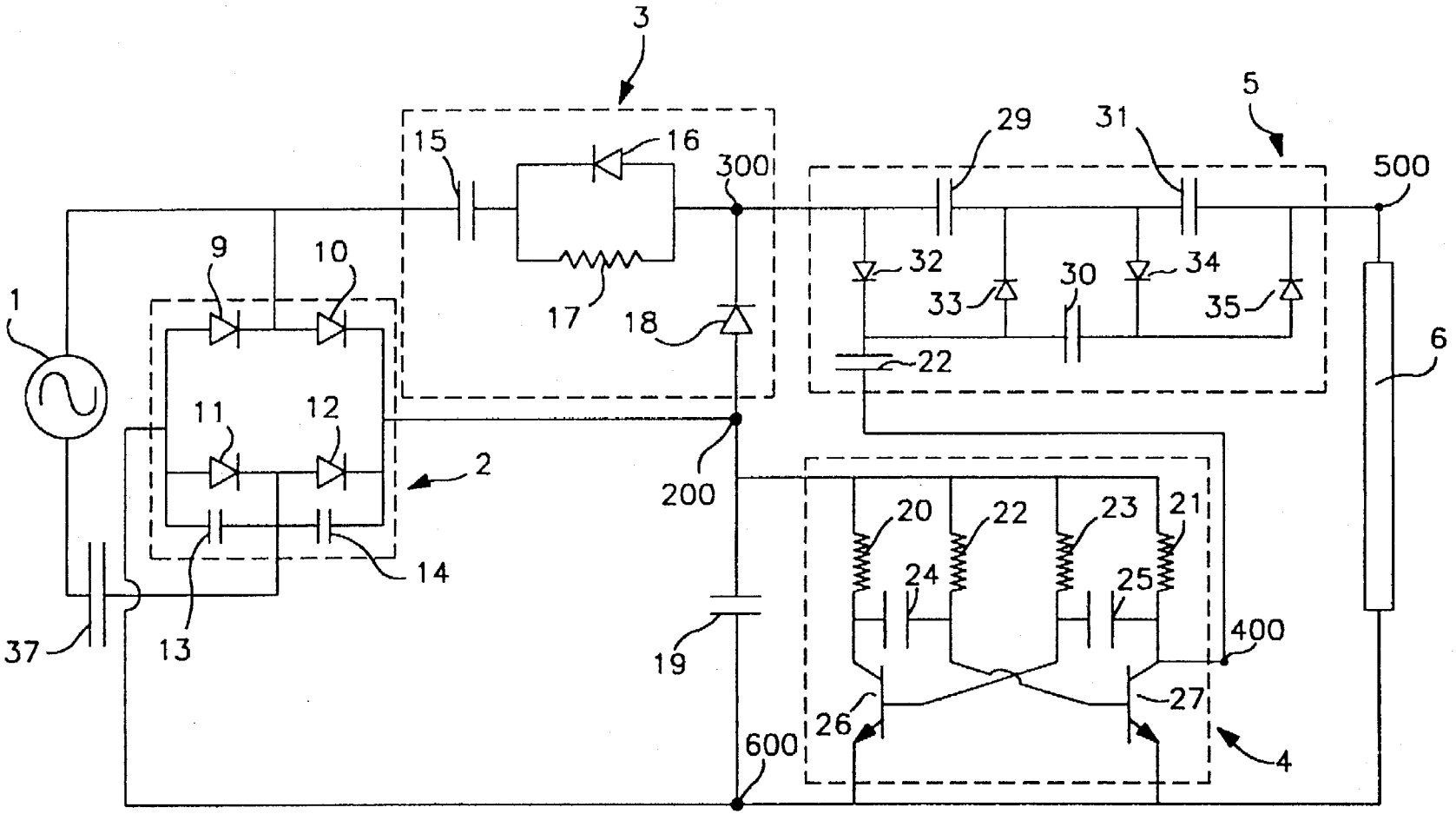
FIG. 5 shows the entire electrical schematic diagram of the ballast circuit of the present invention.

Turning now to FIG. 5, the entire ballast circuit may be observed. Once the lamp 6 is ignited, the impedance presented by it drops dramatically, which permits the entire circuit to switch over from a high frequency ignition current to a DC maintenance current (the current used to maintain the lamp lit). In order for this switch to take place, the following changes in the circuit occur automatically.

The drop in impedance of lamp 6 instantly increases the current running through the entire circuit. This increase in current creates a larger voltage drop across capacitor 37, which significantly lowers the voltage supply ($E_{in}$) which feeds the low power oscillator 4. This voltage drop puts it at a level where the low power oscillator 4 ceases to work (i.e. cease oscillating). This voltage drop at node 200 is further increased by the fact that the dielectric loss in capacitors 13 and 14 is increased such that these components can no longer maintain their charges to quite "double" the voltage.

This effect causes a DC current to flow through node 400, creates an open circuit across capacitor 28, and isolates amplifier 5 from the low oscillator. At the same time, given the increase in current throughout the circuit, the voltage drop across resistor 17 in multiplier circuit 3 becomes significant enough such that the voltage at node 300 is less than the voltage at node 200 ($2\sqrt{2}\,E_{in}$). This difference causes diode 18 to become forward biased which, in turn, allows the DC current output at node 200 to flow through diode 18 and into the amplifier 5. Because this current is DC, capacitors 29, 30 and 31 create open circuits, which requires that the DC current flow through diodes 32, 33, 34 and 35, and then to the lamp 6, hence providing a DC maintenance current.

Table 1 gives illustrative values of circuit elements for use in the preferred embodiment of FIGS. 1–5. This particular ballast circuit 13 is used, ideally, with a 40 W fluorescent lamp and a 120 V, 60 Hz AC source. All diodes are type 1N4004 and both transistors (26 and 27) are type C2611.

TABLE 1

| | |
|---|---|
| Capacitor 37 | 18 μF @ 250 V |
| Capacitor 13 | 4.7 μF @ 250 V |
| Capacitor 14 | 4.7μ @ 250 V |
| Capacitor 19 | 22 μF @ 250 V |
| Capacitor 15 | 3.3 μF @ 350 V |
| Capacitor 28 | 0.15 μF @ 250 V |
| Capaditor 29 | 0.15 μF @ 250 V |
| Capacitor 30 | 0.15 μF @ 250 V |
| Capacitor 31 | 0.15 μF @ 250 V |
| Capacitor 24 | 0.033 μF @ 250 V |
| Capacitor 25 | 0.0027 μF @ 250 V |
| Resistor 17 | 3.9 kΩ @ 1 W |
| Resistor 22 | 1 MΩ @ 0.5 W |
| Resistor 23 | 1 MΩ @ 0.5 W |
| Resistor 21 | 22 kΩ @ 1 W |
| Resistor 20 | 100 kΩ @ 0.5 W |

Using the above configuration, the power required for ignition of the lamp 6 is less than 1 watt. This minimal power requirement is primarily attributable to the fact that the low power oscillator 4 sees a high impedance load at its output, which permits its supply current to be quite low (around the order of 8 mA).

Once the lamp 6 is ignited, the DC maintenance current increases to approximately 200 mA and the voltage potential $E_{in}$ across rectifier/voltage-doubler 2 drops from approximately 116 volts to approximately 27 volts. This drop results in a DC maintenance voltage of $2\sqrt{2}\,E_{in}$, or approximately 75 volts. Thus, in comparison to a conventional electromagnetic ballast system which consumes between 50 to 60 watts to maintain the lamp lit (on AC current), the ballast circuit of the present invention illustrated in FIGS. 1–5 only requires 24 to 27 watts.

Figure 6:
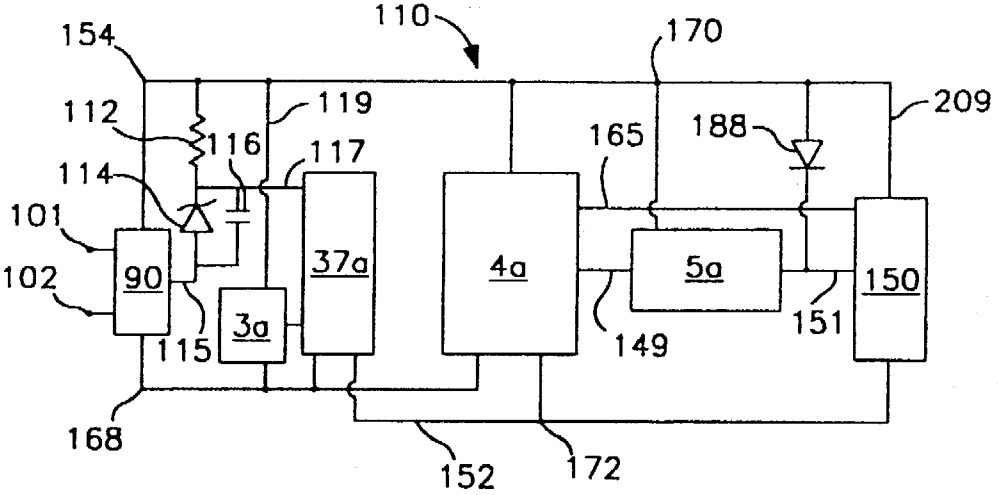
FIG. 6 is a block circuit diagram showing the interconnection between the major components of the present invention in a second preferred embodiment.
Figure 7E:
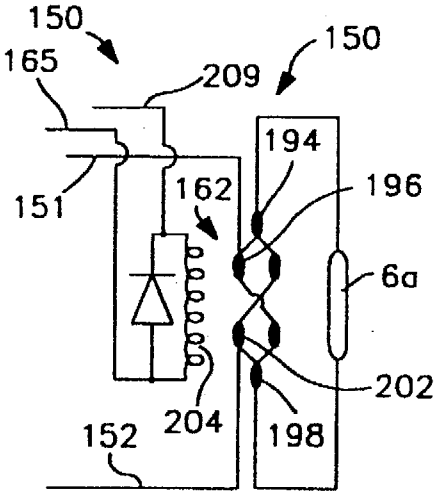
FIGS. 7A–7E are circuit diagrams of the major components of the second preferred embodiment illustrated in FIG. 6.
Figure 7D:
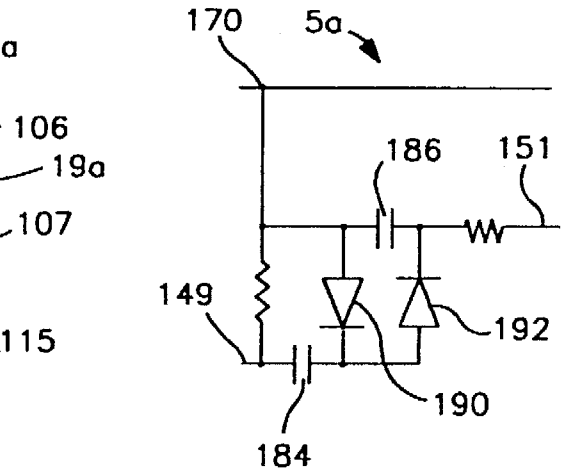
Figure 7A:
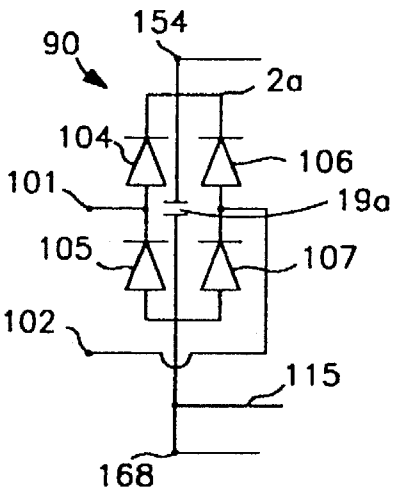
Figure 7B:
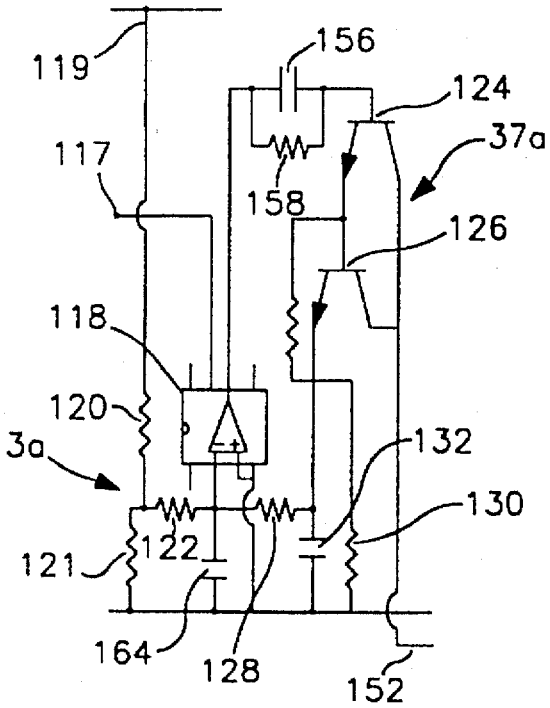

The present invention in a second embodiment shown in FIGS. 6–10 can be used with lamps with or without filaments and replaces capacitor 37 as the ballasting element with electronic gate **37*a* shown in FIGS. 6 and 7B. Electronic gate 37*a* essentially eliminates losses attributable to heat dissipation in conventional ballasts and optimizes actual ballasting parameters with feedback. This loss elimination also permits ballast 110 to be made smaller and lighter than conventional ballasts, including electronic ones, for manufacture as an integrated circuit. In the preferred embodiment, the ballasting by electronic gate 37***a* responds to feedback from the input voltage, the lamp impedance (by measuring the load current) and, in some embodiments, temperature.

The alternative embodiment, ballast 110, as shown in FIG. 6 contains many features similar to those of the first embodiment shown in FIGS. 1–5, with like parts bearing like numbers. A 120 V, 60 Hz power signal is supplied to ballast 110 via leads 101–102 shown in FIGS. 6 and 7A to full-wave bridge rectifier 2*a* comprised, as shown in FIG. 7A, of diodes 104–107. FIG. 7A also shows filter 19*a*, which decreases the remaining ridge of the rectified power signal. Filter 19*a* and rectifier 2*a* are represented in FIG. 6 by block 90 and can be of any suitable design known in the art.

Returning to FIG. 6, the output of rectifier 2*a* and filter 19*a* is then used to power comparator 118 shown in FIG. 7B, of electronic gate 37*a* and to provide input thereto. Resistor 112, zener diode 114, and electrolytic capacitor 116 in FIG. 6 receive input via line 115 and then condition the received input to output a 24 volt power to comparator 118 of electronic gate 37*a* via line 117. Resistor 112 limits the current through diode 114 and capacitor 116 opposes quick voltage changes across diode 114. Again, resistor 112, zener diode 114, and electrolytic capacitor 116 may be replaced in alternative embodiments with any suitable design known in the art.

Figure 9C:
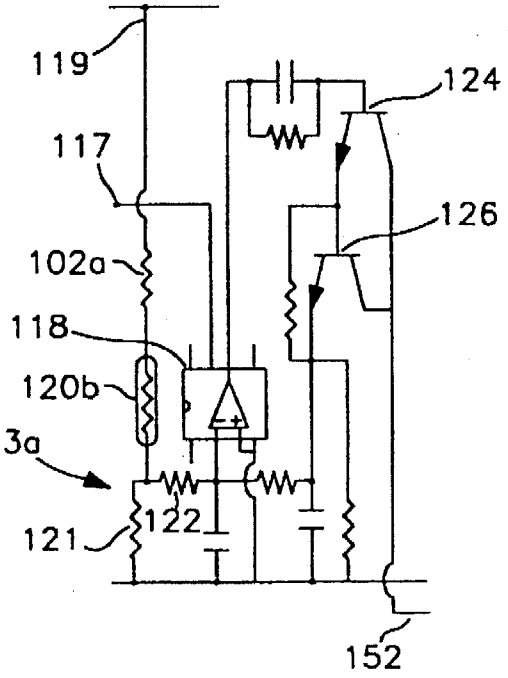
FIGS. 9A–9C illustrate alternative embodiments of the voltage divider and electronic gate of FIG. 7B.
Figure 9B:
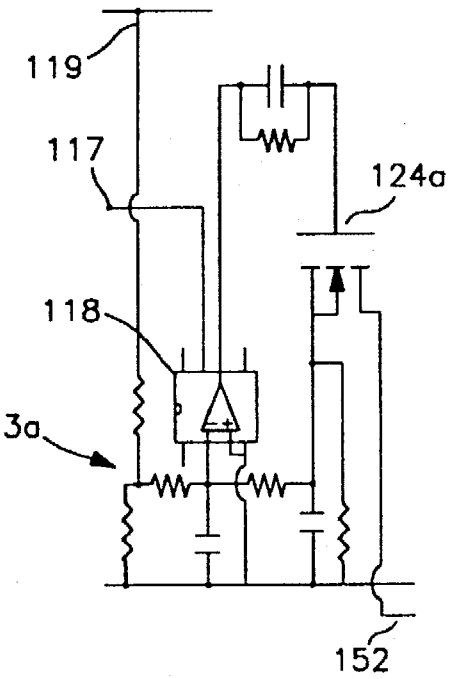
Figure 9A:
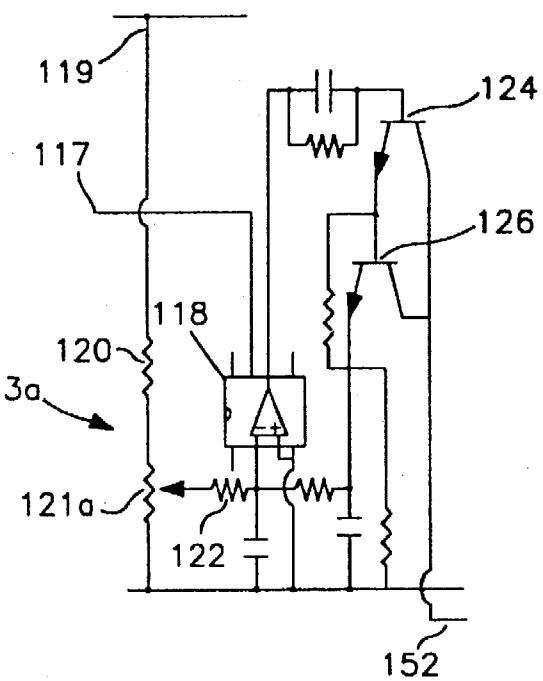

Voltage divider 3*a* shown in both FIG. 6 and in FIG. 7B comprises resistors 120–122, through which the inverting terminal of comparator 118 receives a negative feedback signal of the input voltage at node 154 via line 119. Feedback from the input voltage permits the ballast to respond adequately to even severe voltage transients as described below represented by variations in the voltage divider input. This feedback also allows the lamp to essentially maintain the same consumption at different voltage levels (within a certain range), which is not true for conventional electromagnetic or electronic ballasts. As shown in FIG. 9A, ballast 110 can be modified to include a dimmer by replacing resistor 121 with potentiometer 121*a*.

Still referring to FIGS. 6 and 7B, the operation of ballast 110 revolves around the electronic gate 37*a* comprised of gating elements and elements for controlling the gating elements. Comparator 118 is an LM307, a common integrated circuit well known to those in the art. The output of voltage divider 3*a* provides feedback permitting comparator 118, and hence electronic gate 37*a*, to output a signal inversely proportional to the voltage at node 154. The output of comparator 118 and consequently electronic gate 37*a* is therefore responsive variations in the voltage divider output and, consequently, to variations in the voltage supply.

The operation of electronic gate 37*a* is also responsive to the lamp impedance via feedback through line 152 shown in FIGS. 6 and 7B. When the lamp is struck and becomes lighted, lamp impedance is very low and the current in ballast circuit 110 becomes very high since electronic gate 37*a* receives the load current as feedback via line 152. The load current is sensed by comparator 118 through resistor 130 in parallel with capacitor 132 sending this signal through resistor 128 to the inverting terminal of comparator 118. This high load current is consequently limited by transistors 124 and 126. Transistors 124 and 126 are wired in a Darlington configuration while capacitor 156 helps transistor 124 out of saturation and resistor 158 limits current to transistor 124.

Figure 10:
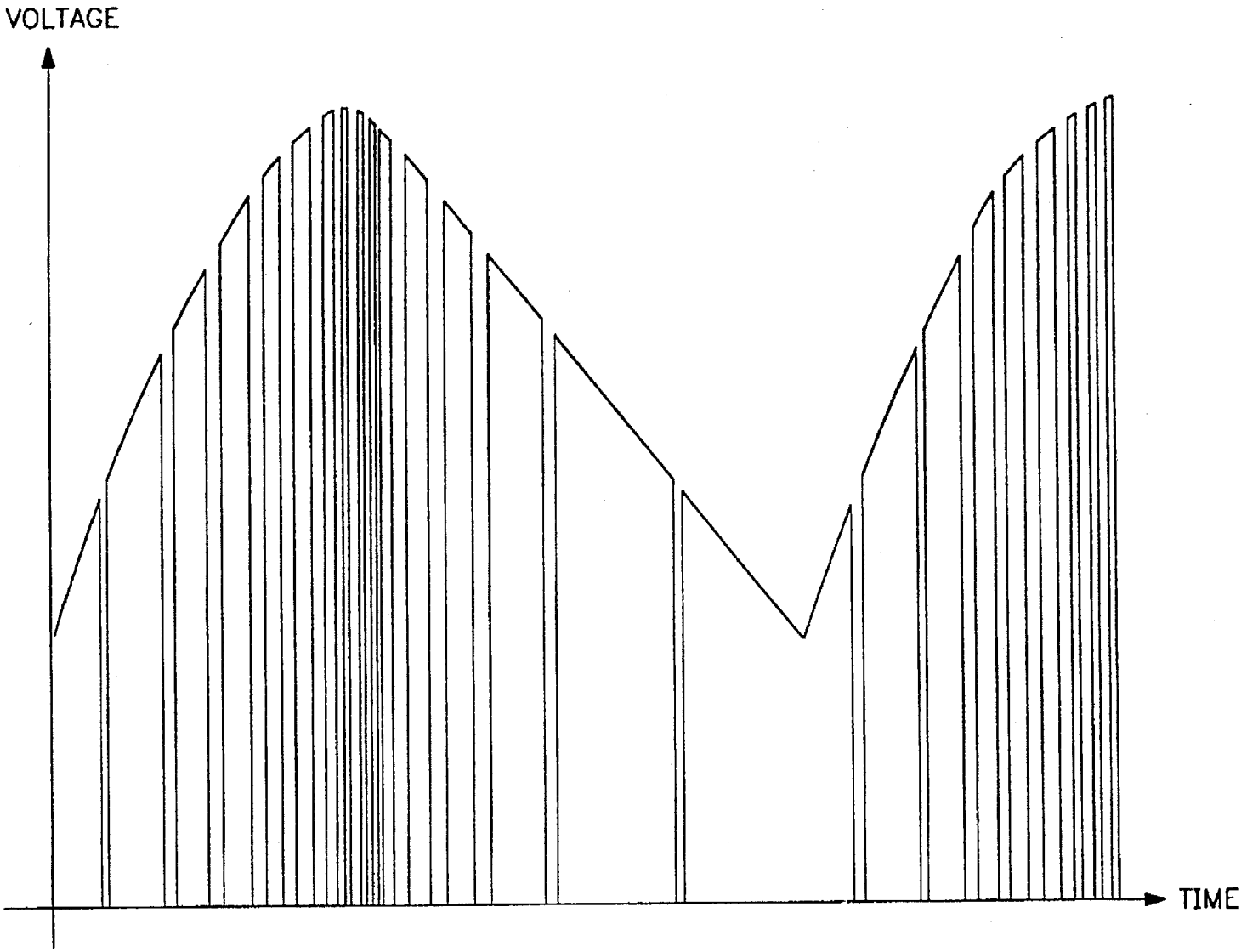
FIG. 10 illustrates the gated output of the voltage divider and electronic gate of FIG. 7B.

Generally, transistors 124 and 126 saturate, and therefore conduct, when comparator 118 output is high and do not conduct when comparator 118 output is low. In response to the feedback signals, comparator 118 and transistors 124 and 126 pulse-width and frequency modulate a signal output by electronic gate 37*a* to lamp 6*a* as shown in FIG. 10. When the voltage supply on leads 101–102 is steady, an increase in lamp impedance decreases the frequency and increases the pulse-width of the gated output and a decrease in lamp impedance increases the frequency and decreases the pulse-width of the gated output. When the lamp impedance is steady, increases in the voltage supply increase the frequency and decrease the pulse-width of the gated output and a decrease in the supply voltage decreases the frequency and increases the pulse-width of the gated output.

Electronic gate 37*a* therefore essentially comprises a means for gating an output to lamp 6*a* and means for controlling the gating means. In the embodiment shown in FIG. 7B, the gating means includes transistors 124 and 126, but may alternatively include a power MOSFET 124*a* as shown in FIG. 9B. Likewise, the control means in FIG. 7B includes comparator 118 and is responsive to variations in supply voltage and in lamp impedance, but may also be responsive to temperature by replacing resistor 120 of voltage divider 3*a* with limiting resistor 120*a* and thermistor 120*b* as shown in FIG. 9C.

Preferably, one can simply take advantage of the thermal variation of the null offset of the inverter pin on comparator 118 in order to introduce a temperature feedback. In order to do this, one can run a thermally conductive strip between the ballast box and the comparator chip, sealing both ends with a bonder having good thermal conduction characteristics. In this manner, the comparator 118 chip will heat up and cool down in response to external temperature changes, which will in turn cause the null offset at the inverting terminal to go up or down. Depending on the calibration given, one can arrange the thermal feedback system to shut off the ballast and the lamp until reasonable operating temperatures are re-obtained. This characteristic of the ballast gives it some very important fire safety features such as an automatic shut-off during a fire.

Figure 7C:
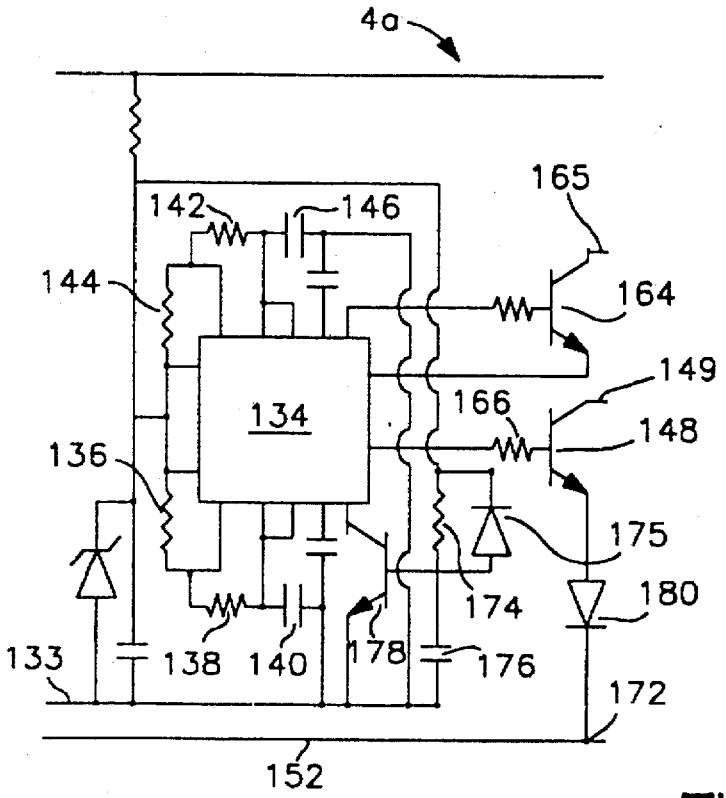
Figure 8:
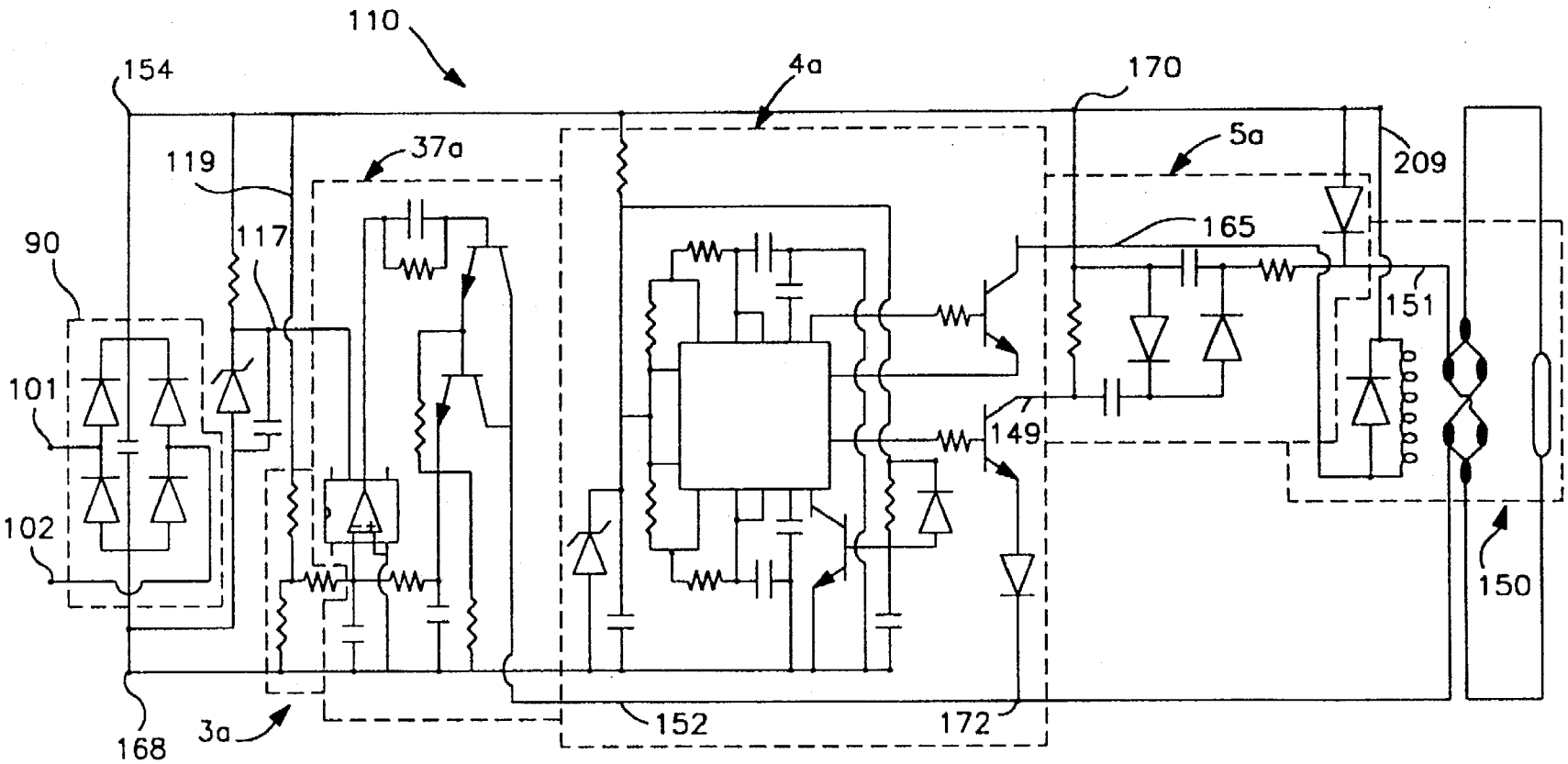
FIG. 8 is a circuit diagram of the second preferred embodiment illustrated in FIG. 6 incorporating the detail of FIGS. 7A–7E instead of the blocks of FIG. 6.

Although electronic gate 37*a* performs the ballasting once lamp 6*a* is lit, oscillator 4*a* is in charge of igniting the lamp when the ballast is initially energized and when the lamp is still unlit. The embodiment of oscillator 4*a* shown in FIG. 7C includes the well-known LMC556 integrated circuit, which contains two astable multivibrators (astables). In accord with well known principles, the frequency of the output signals is governed by two external resistors and one capacitor. In the case of the astable 134 used for igniting the lamp, the corresponding resistors and capacitors are resistors 136 and 138 and capacitor 140 as seen in FIG. 7C. The other astable 135 is used to control the switching frequency of the polarity switching means for the lamp when required, and is described more fully below. It will be appreciated by those versed in the art that if no switching means are used, or a switching means where no oscillator is required, then one could simply use an LMC555 (which includes only one astable oscillator) for astable 134.

A stable 134 generates an output signal of approximately 25 kHz (this frequency can be optimized depending on the type of lamp) to the amplifier 5*a*, shown in FIGS. 6 and 7D, via transistor 148 on line 149. Amplifier 5*a* then amplifies the voltage of the output from the oscillator 4*a* to a level sufficient to strike lamp 6*a* shown in FIG. 7E.

A small predetermined time after the ballast is energized, which is determined by resistor 174 and capacitor 176, transistor 178 begins conducting when capacitor 176 charges to the saturation level of transistor 178. Transistor 178's output is wired to the "reset" of astable 134 and switches low to turn off astable 134 when transistor 178 conducts. Diode 180 ensures that transistor 178 turns off at this time even when the output of astable 134 is not exactly zero volts. Capacitors 184 and 186 then switch out of amplifier 5a when transistor 178 is turned off because of the shorter path between nodes 170 and 151 through diode 188, which is half that present across diodes 190 and 192. Thus, what happens generally is that a short period after the ballast is energized, preferably between 0.5 to 1.5 seconds, period during which the lamp will ignite, the oscillator shuts off, switching out the amplifier, and allowing electronic gate 37a to take over and maintain the lamp lit.

One will note that in the oscillator 4a circuit drawn in FIG. 7C there is a diode 175 in parallel with resistor 174. The purpose of this diode is to allow capacitor 176 to discharge completely and practically immediately when the lamp turns off (e.g. the ballast circuit is turned off, low voltage supply feedback, high ambient temperature feedback, etc.). The purpose of allowing capacitor 176 to discharge immediately is to permit the ballast circuit to ignite the lamp immediately when it is shut-off and then re-energized shortly thereafter. If capacitor 176 was not fully discharged, the period of time during which astable 134 would be turned on would not be long enough to permit it to achieve full amplitude and thus insufficient to ignite the lamp. The reason is because the capacitor's voltage level, not having fully discharged, would be closer to the saturation level of transistor 178, and thus would reach that saturation level quicker, which would in turn zero the astable 134's trigger quicker. In some cases it may be desirable to eliminate diode 175 in order for ensure that the conditions which caused the lamp to turn off (e.g. a fire in the ceiling) had subsided.

When lamp 6a is unlit, lamp impedance is very high and load current in ballast circuit 110 is practically zero as is the voltage across resistor 130 shown in FIG. 7B in parallel with capacitor 132. When ballast circuit 110 is first energized, the feedback to comparator 118 via resistor 122 is still too low to switch comparator 118 to low, so transistors 124 and 126 are saturated and conducting. Further, in lamping circuit 150 shown in FIG. 7E, switch 194 is set to pole 196 and switch 198 is set to pole 202.

Once lamp 6a is struck and lit, a load current output to transistors 124 and 126 via line 152 begins circulating from the emitter to the collector of transistor 126 as both of transistors 124 and 126 are conducting. As lamp 6a remains lit, the load current increases, which increase comparator 118 senses through resistor 130 and 128. The sum of the feedback across resistors 122 and 128 charges capacitor 164, such that comparator 118 switches to low as the voltage at the inverting terminal of comparator 118 exceeds that of the voltage at the non-inverting terminal. It may be noted that under ideal (theoretical) conditions the feedback arrangement at the inverting terminal of comparator 118 would not be adequate to switch the electronic gate 37a because one would have to have a voltage below the reference voltage at the non-inverting terminal, which is impossible. Thus, I take advantage of the real-world null offset present between the comparator 118's inverting and non-inverting terminals, which is approximately 0.7 volts. Likewise, I use this offset in order to calibrate a temperature feedback when using the comparator 118 as the temperature transducer for the temperature feedback.

Transistors 124 and 126 then stop conducting when comparator 118's output switches low, thus causing the load current to drop to zero. The drop in load current across resistor 130 enables capacitor 164 to discharge and comparator 118's output switches high. Larger load currents therefore charge capacitor 164 more quickly and transistors 124 and 126 conduct for shorter periods of time. This increases the gating frequency and, thus as shown in FIG. 10, the number of zero-intervals and their corresponding periods increases with the load current and the output of voltage divider 3a.

Using the electronic gating method described above, there is no need to limit or regulate the current by dissipation through resistive or reactive elements. Instead, the $T_{off}/T_{on}$ period is regulated to vastly improve the lamp's efficiency. The preferred embodiment also includes means for switching the polarity of the signal through lamp 6a for use with lamps in which mercury migration or anode darkening is a concern. In lamps in which these effects are negligible, this switching means may be omitted completely. In FIG. 7E, the switching means includes relay 162, which receives a second and separate output from astable 135 in oscillator 4a via transistor 164 on line 165. Relay 162 controls the operation of switches 194 and 198 of lamping circuit 150 that determine the polarity of the signal through lamp 6a. When ballast circuit 110 is first energized, switches 194 and 198 shown in FIG. 7E of lamping circuit 150 are set to poles 196 and 202, respectively, and astable 135 controls relay coil 204 of lamping circuit 150 via transistor 164. Resistors 142 and 144 and capacitor 146 control the switching frequency of transistor 164 and thus the on/off period of relay coil 204. Typical switching periods used in this embodiment vary between 3 to 6 hours for T-12 40W lamps. As relay coil 204 switches, switches 194 and 198 also switch between alternate poles. Of course, it will be understood by those versed in the art that other switching arrangements besides relays can be used to perform the switching when necessary.

It should be understood that the above described embodiments are intended to illustrate, rather than limit, the invention and that numerous modifications could be made thereto without departing from the scope of the invention as defined by the appended claims. Thus, while the present invention has been illustrated in some detail according to the preferred embodiment shown in the foregoing drawings and description, it will become apparent to those skilled in the art that variations and equivalents may be made within the spirit and scope of that which has been expressly disclosed. Accordingly, it is intended that the scope of the invention be limited solely by the scope of the hereafter appended claims and not by any specific wording in the foregoing description.

What is claimed is:

1. A transformerless ballast for a gaseous discharge lamp, comprising:

a rectifier;

a filter for the rectifier output;

a voltage divider for the filter output;

means for gating the filter output, the gating means output powering a lamp when the lamp is lit;

means including a comparator for controlling the gating means responsive to variations in lamp impedance;

an oscillator generating an output until after the lamp is lit; and an amplifier receiving and amplifying the oscillator output for powering the lamp when the lamp is unlit.

2. The ballast of claim 1, wherein the rectifier is a full-wave, bridge rectifier.

3. The ballast of claim 1, wherein the gating means includes two Darlington-configured transistors.

4. The ballast of claim 1, wherein the gating means includes a power MOSFET.

5. The ballast of claim 1, wherein the gating means frequency and pulse-width modulates the filter output.

6. The ballast of claim 1, wherein the means for controlling the gating means is also responsive to variations in temperature.

7. The ballast of claim 1, wherein the means for controlling the gating means is also responsive to variations in the voltage divider output.

8. The ballast of claim 1, wherein the means for controlling the gating means is also responsive to variations in the voltage divider output.

9. The ballast of claim 1, wherein the oscillator generates an output for a predetermined period of time greater than the time expected for the lamp to light.

10. The ballast of claim 1, including means for switching the polarity of the amplified oscillator output to the lamp.

11. The ballast of claim 1, wherein the voltage divider includes means for varying the luminosity of the lamp.

12. A transformerless ballast for a gaseous discharge lamp, comprising:

a rectifier;

a filter for the rectifier output;

a voltage divider for the filter output;

means for gating the filter output, the gating means output powering a lamp when the lamp is lit;

means including a comparator for controlling the gating means responsive to variations in the voltage divider output;

an oscillator generating an output until after the lamp is lit; and an amplifier receiving and amplifying the oscillator output for powering the lamp when the lamp is unlit.

13. The ballast of claim 12, wherein the rectifier is a full-wave, bridge rectifier.

14. The ballast of claim 12, wherein the gating means includes two Darlington-configured transistors.

15. The ballast of claim 12, wherein the gating means includes a power MOSFET.

16. The ballast of claim 12, wherein the gating means frequency and pulse-width modulates the filter output.

17. The ballast of claim 12, wherein the means for controlling the gating means is also responsive to variations in temperature.

18. The ballast of claim 12, wherein the oscillator generates an output for a predetermined period of time greater than the time expected for the lamp to light.

19. The ballast of claim 12, including means for switching the polarity of the amplified oscillator output to the lamp.

20. The ballast of claim 12, wherein the voltage divider includes means for varying the luminosity of the lamp.

* * * * *